United States Patent [19]

Kawamura

[11] Patent Number: 5,050,543

[45] Date of Patent: Sep. 24, 1991

[54] VALVE CONTROL SYSTEM FOR INTERNAL COMBUSTION ENGINE

[75] Inventor: Hideo Kawamura, Samukawa, Japan

[73] Assignee: Isuzu Motors Limited, Tokyo, Japan

[21] Appl. No.: 429,477

[22] Filed: Oct. 31, 1989

[30] Foreign Application Priority Data

Oct. 31, 1988 [JP] Japan ..... 63-275307

[51] Int. Cl.[5] ..... F01L 9/04

[52] U.S. Cl. ..... 123/90.11

[58] Field of Search ..... 123/90.11, 90.15, 188 AA

[56] References Cited

U.S. PATENT DOCUMENTS

| | | | |
|---|---|---|---|
| 3,682,152 | 8/1972 | Muller-Berner | 123/90.11 |
| 3,967,602 | 7/1976 | Brown | 123/90.55 |
| 4,258,672 | 3/1981 | Hietikko | 123/90.18 |
| 4,359,022 | 11/1982 | Nakamura et al. | 123/188 AA |
| 4,544,986 | 7/1986 | Long | 123/90.51 |
| 4,598,675 | 10/1985 | Büchl | 123/90.11 |
| 4,614,170 | 9/1986 | Pishinger et al. | 123/90.11 |
| 4,615,306 | 10/1986 | Wakeman | 123/90.16 |
| 4,700,684 | 10/1987 | Pishinger et al. | 123/90.11 |
| 4,722,315 | 2/1988 | Pickel | 123/90.11 |
| 4,829,947 | 5/1989 | Lequesne | 123/90.11 |
| 4,831,973 | 5/1989 | Richeson, Jr. | 123/90.11 |
| 4,841,923 | 6/1989 | Buchl | 123/90.11 |
| 4,846,120 | 7/1989 | Büchl | 123/90.11 |

*Primary Examiner*—David A. Okonsky
*Assistant Examiner*—Weilun Lo
*Attorney, Agent, or Firm*—Staas & Halsey

[57] ABSTRACT

A control system for controlling intake and exhaust valves of an internal combustion engine includes an electromagnetic actuator means for electromagnetically operating the intake and exhaust valves. The electromagnetic actuator means is controlled depending on the rotational speed of the engine such that the duration in which the intake and exhaust valves are open will be smaller when the engine rotational speed is lower and larger when the engine rotational speed is higher. With this arrangement, the intake and exhaust efficiencies are increased in the full range of engine rotational speeds.

1 Claim, 4 Drawing Sheets

VALVE CONTROL SYSTEM FOR INTERNAL COMBUSTION ENGINE

BACKGROUND OF THE INVENTION

The present invention relates to a valve control system for electromagnetically actuating intake and exhaust valves of an internal combustion engine.

FIG. 2 of the accompanying drawings shows a conventional internal combustion engine. When fuel is combusted in a combustion chamber 1, a piston 2 is lowered to rotate a crankshaft 4 through a connecting rod 3. Intake and exhaust valves 8, 9 disposed in a cylinder head are opened and closed by rocker arms 6, 7 operated by a camshaft 5 which is operatively coupled to the crankshaft 4 by a timing belt and pulleys.

When the internal combustion engine operates in a high-speed range, periods of time required to introduce intake air and discharge exhaust gases are shorter than those during low-speed operation, and hence intake air has to be introduced and exhaust gases have to be discharged quickly. The amounts of intake air introduced and exhaust gases discharged are lowered, resulting in a reduction in volumetric efficiency of intake air. It is desirable that the angle in which the intake and exhaust valves are open with respect to the crankshaft angle be smaller when the engine rotational speed is lower and larger when the engine rotational speed is higher.

However, since the intake and exhaust valves are opened and closed by cams on the camshaft 5 that rotates in synchronism with the crankshaft 4, as described above, the valve opening angle is determined solely by the profile of the cams. It is impossible to vary the valve opening angle depending on the engine rotational speed.

Valve control systems in which intake and exhaust valves are operated by electromagnetic actuator means have been proposed as disclosed in Japanese Laid-Open Patent Publications Nos. 58-183805 and 61-76713. These publications only disclose that the intake and exhaust valves are operated by the electromagnetic actuator means.

SUMMARY OF THE INVENTION

It is an object of the present invention to provide a control system for controlling the intake and exhaust valves of an internal combustion engine, the control system including an electromagnetic actuator means for electromagnetically actuating the intake and exhaust valves, the electromagnetic actuator means being controlled depending on the rotational speed of the engine such that the angle in which the intake and exhaust valves are open with respect to the crankshaft angle is smaller when the engine rotational speed is lower and larger when the engine rotational speed is higher, so that the volumetric efficiency of intake air will be high in the entire range of engine rotational speeds.

According to the present invention, there is provided a control system for controlling intake and exhaust valves of an internal combustion engine, comprising electromagnetic actuator means for opening and closing the intake and exhaust valves, an engine speed sensor for detecting the rotational speed of the internal combustion engine, a crankshaft angle sensor for detecting the angular position of the crankshaft of the internal combustion engine, calculating means for calculating angular positions in which the intake and exhaust valves are to be opened and closed with respect to the crankshaft angle, based on detected signals from the engine speed sensor and the crankshaft angle sensor, and control means for applying drive signals to the electromagnetic actuator means in response to the calculated angular positions.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIG. 3(*b*) is a diagram showing the relationship between engine rotational speeds and angular positions where the valves are opened and closed.

DETAILED DESCRIPTION OF THE PREFERRED EMBODIMENT

Figure 1:
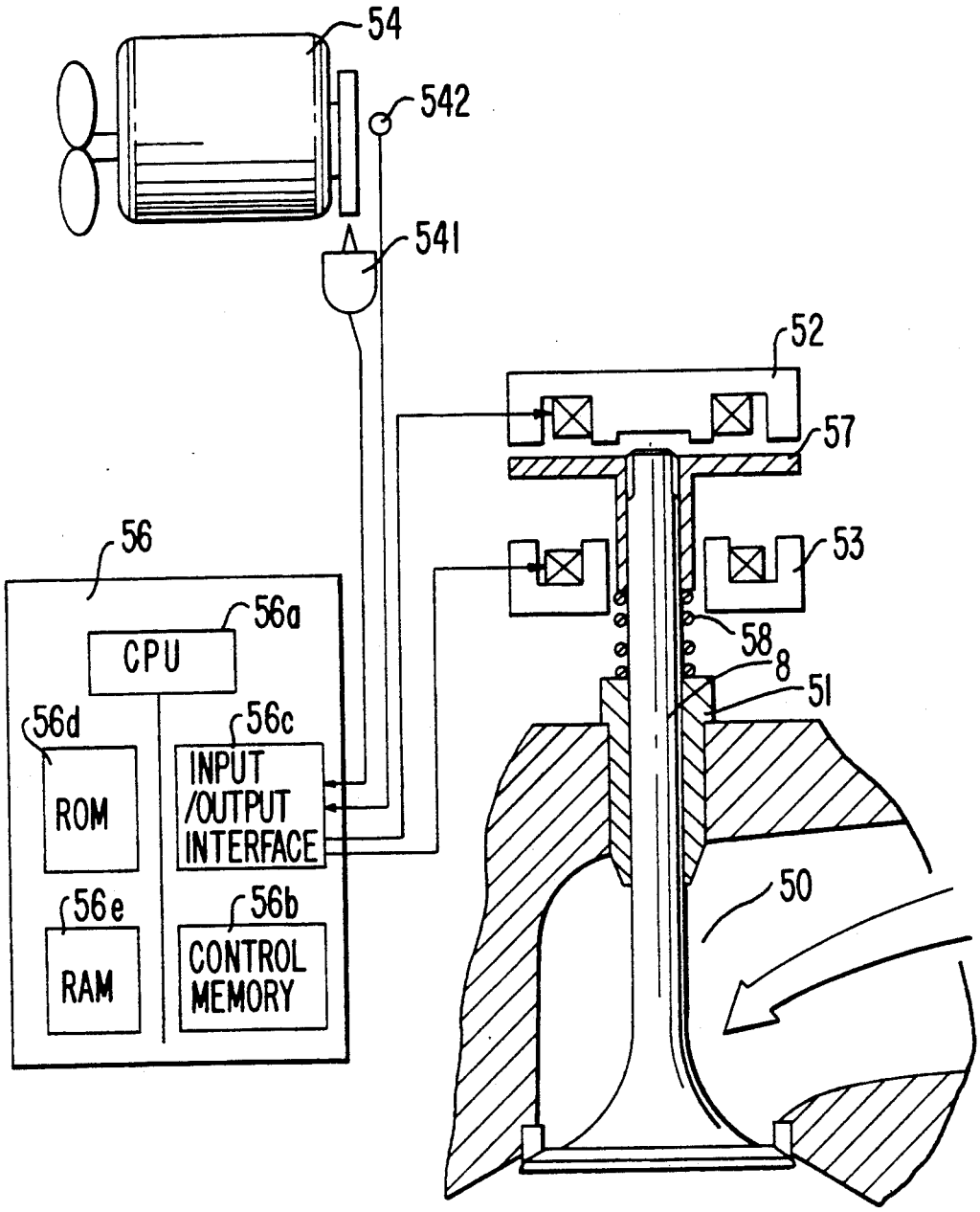
FIG. 1 is a schematic view, partly in block form, of a valve control system for an internal combustion engine according to the present invention.
Figure 2:
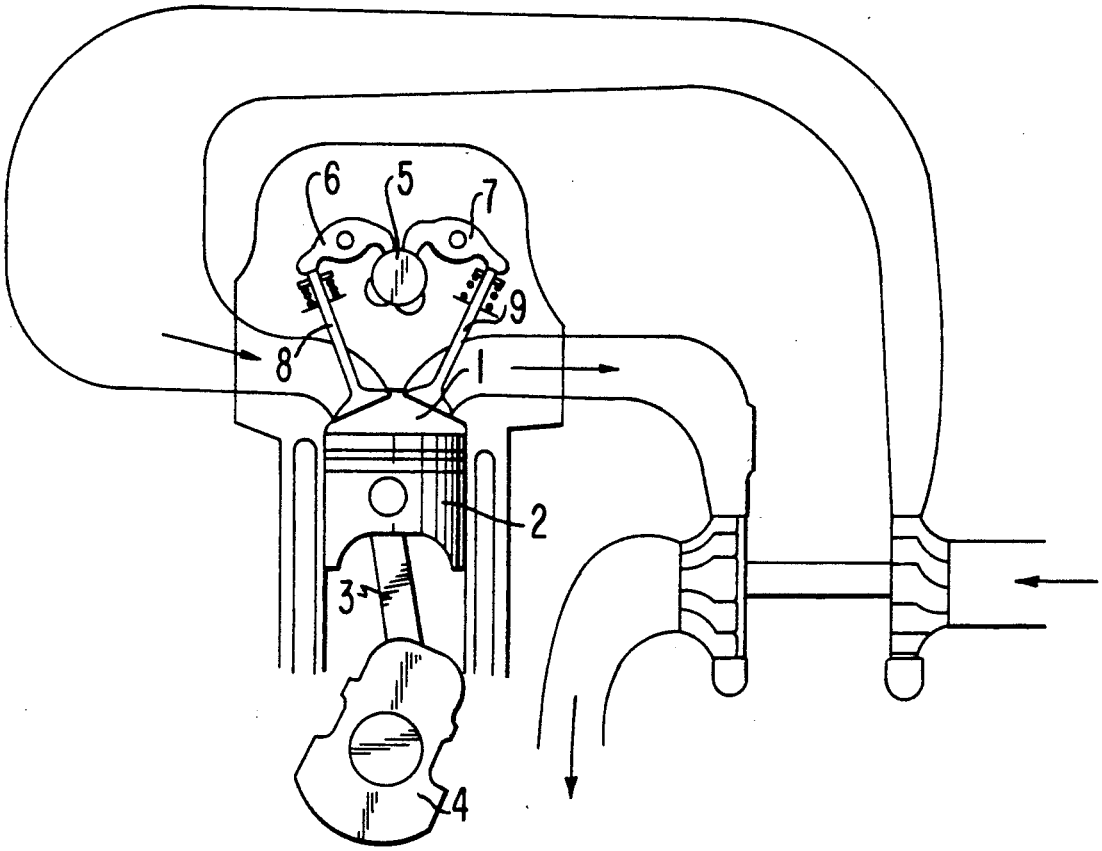
FIG. 2 PRIOR ART
FIG. 2 is a schematic view of a conventional intake and exhaust valve operating mechanism in an internal combustion engine.

FIG. 1 shows a valve control system for an internal combustion engine according to the present invention.

As shown in FIG. 1, an internal combustion engine 54 has an intake valve 8 in each of the cylinders. The intake valve 8 is made of a ceramic material such as silicon nitride or silicon carbide, and is slidably fitted in a valve guide 51 mounted in a cylinder head and made of a ceramic material such as silicon nitride or silicon carbide. A movable member 57 of a magnetic material is fixedly fitted over the upper end of the stem of the intake valve 8. An upper electromagnet 52 and a lower electromagnet 53 are disposed above and below, respectively, the movable member 57 in spaced-apart relation thereto. Between the valve guide 51 and the movable member 57, there is disposed a coil spring 58 for normally urging the intake valve 8 to close the intake port so that the intake valve 8 is prevented from being unseated or lowered when the upper and lower electromagnets 52, 53 are de-energized. An exhaust valve (not shown) is also operated by a valve operating means which is of the same construction as described above and which will not be described in detail.

When the valve 8 is closed, the coil of the upper electromagnet 52 is continuously energized to attract the movable member 57 upwardly, thereby keeping the valve 8 closed. To open the valve 8, the coil of the upper electromagnet 52 is de-energized to release the movable member 57 off the upward attractive force, and the coil of the lower electromagnet 53 is simultaneously energized to produce a downward attractive force. The movable member 57 is therefore attracted to the lower electromagnet 53 to move the valve 8 downwardly, thus opening the intake port. In order to close the valve from the open condition, the coil of the lower electromagnet 53 is de-energized to free the movable member 57 from the downward attractive force and the coil of the upper electromagnet 52 is energized to attract the movable member 57 upwardly. Drive signals to energize the upper and lower electromagnets 52 53 are generated by a control unit 56 described below.

The control unit 56 comprises a central processing unit (CPU) 56*a* for effecting arithmetic operations according to a program, a read-only memory (ROM) 56*d* for storing the program and various preset values such as a lookup table of angular positions where the intake and exhaust valves are to be opened and closed with respect to the crankshaft angles depending on engine rotational speeds, a random access memory (RAM) 56*e* for temporarily storing the results of arithmetic operations carried out by the CPU 56*a* and data, a control memory 56*b* for controlling the operation of various components of the control unit 56, and an input/output interface 56*c*.

The rotational speed of the engine 54 is detected by a engine rotational speed sensor 541, and the top dead center of the piston in each cylinder and the angular position of the crankshaft of the engine 54 are detected by a crankshaft angle sensor 542. Detected signals from the sensors 541, 542 are applied to the input/output interface 56*c* of the control unit 56.

The valve control system of the present invention will be described below.

The control unit 56 receives the crankshaft angle signal and the engine rotational speed signal from the crankshaft angle sensor 542 and the engine rotational speed sensor 541 through the input/output interface 56*c*, and stores the received signals in the RAM 56*e*. Then, the control unit 56 determines positions where the intake and exhaust valves are to be opened and closed, from the lookup table stored in the ROM 56*d* based on the crankshaft angle signal and the engine rotational speed signal which are stored in the RAM 56*e*.

Figure 3A:
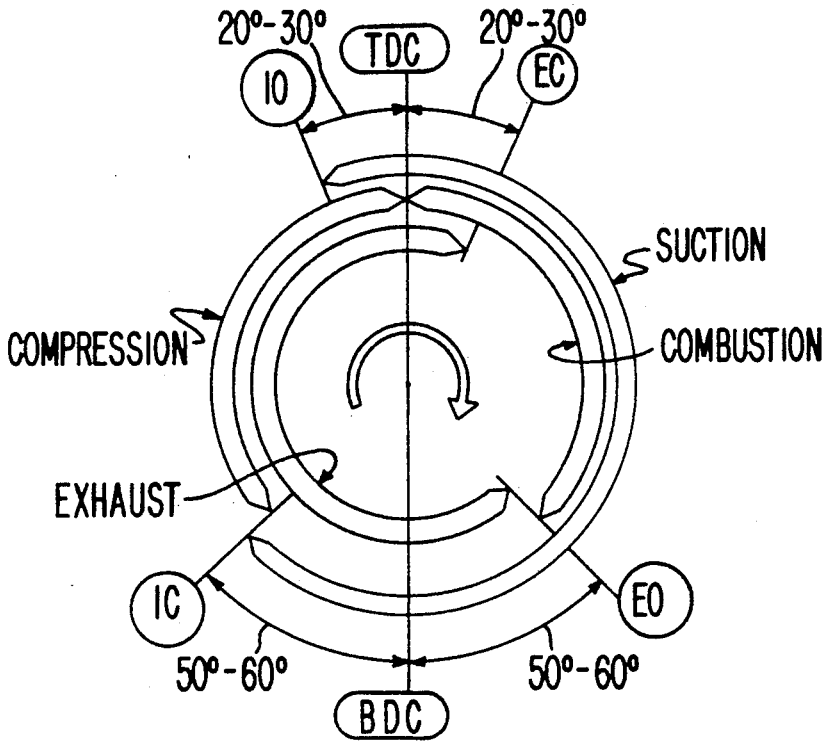
FIG. 3(*a*) is a diagram showing the timing at which intake and exhaust valves are opened and closed.
Figure 3B:
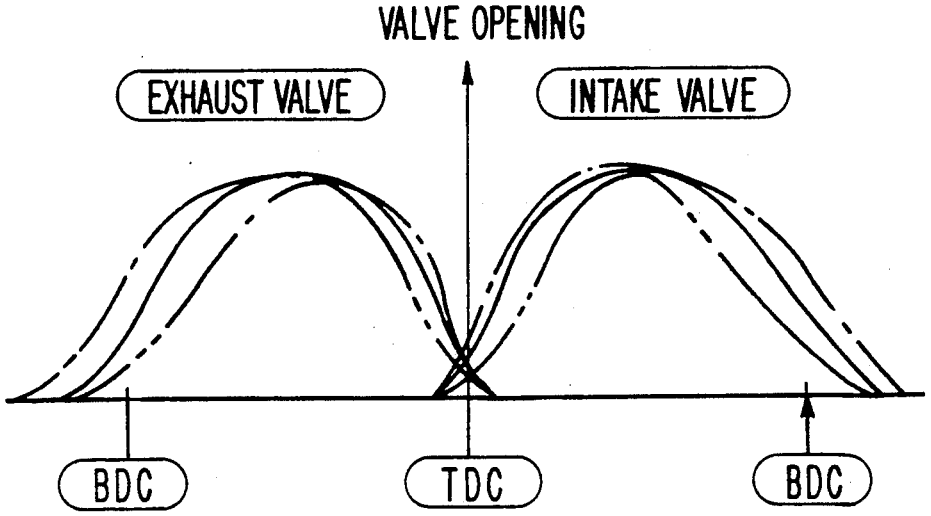

The lookup table stored in the ROM 56*d* will be described below with reference to FIGS. 3(*a*) and 3(*b*). FIG. 3(*a*) shows the timing at which the intake and exhaust valves are opened and closed, and FIG. 3(*b*) shows the relationship between engine rotational speeds and angular positions where the valves are opened and closed. The horizontal axis of the graph of FIG. 3(*b*) indicates crankshaft angles, with the top dead center (TDC) being on its center, and the bottom dead center (BDC) being on its left and right ends. The vertical axis of FIG. 3(*b*) represents the opening of the intake and exhaust valves, the valves being progressively more opened upwardly along the vertical axis and more closed downwardly along the vertical axis. The manner in which the exhaust valve is opened and closed is shown on the lefthand side of the graph of FIG. 3(*b*), whereas the manner in which the intake valve is opened and closed is shown on the righthand side of the graph. The solid-line curves indicate the opening and closing of the intake and exhaust valves which would be determined solely by a cam profile according to the conventional valve operating system. The manner in which the intake and exhaust valves are controlled according to the present invention while the engine rotational speed is higher is represented by the dot-and-dash-line curves, and the manner in which the intake and exhaust valves are controlled according to the present invention while the engine rotational speed is lower is represented by the two-dot-and-dash-line curves.

As illustrated in FIG. 3(*b*), the valve control system of the present invention increases the total angle in which the intake and exhaust valves ar open with respect to the crankshaft angle when the engine rotational speed is higher, and reduces the total angle in which the intake and exhaust valves are open with respect to the crankshaft angle when the engine rotational speed is lower.

A process of controlling the supply of electric power to the upper and lower electromagnets 52, 53 during the valve control will be described with reference to FIG. 4.

Figure 4:
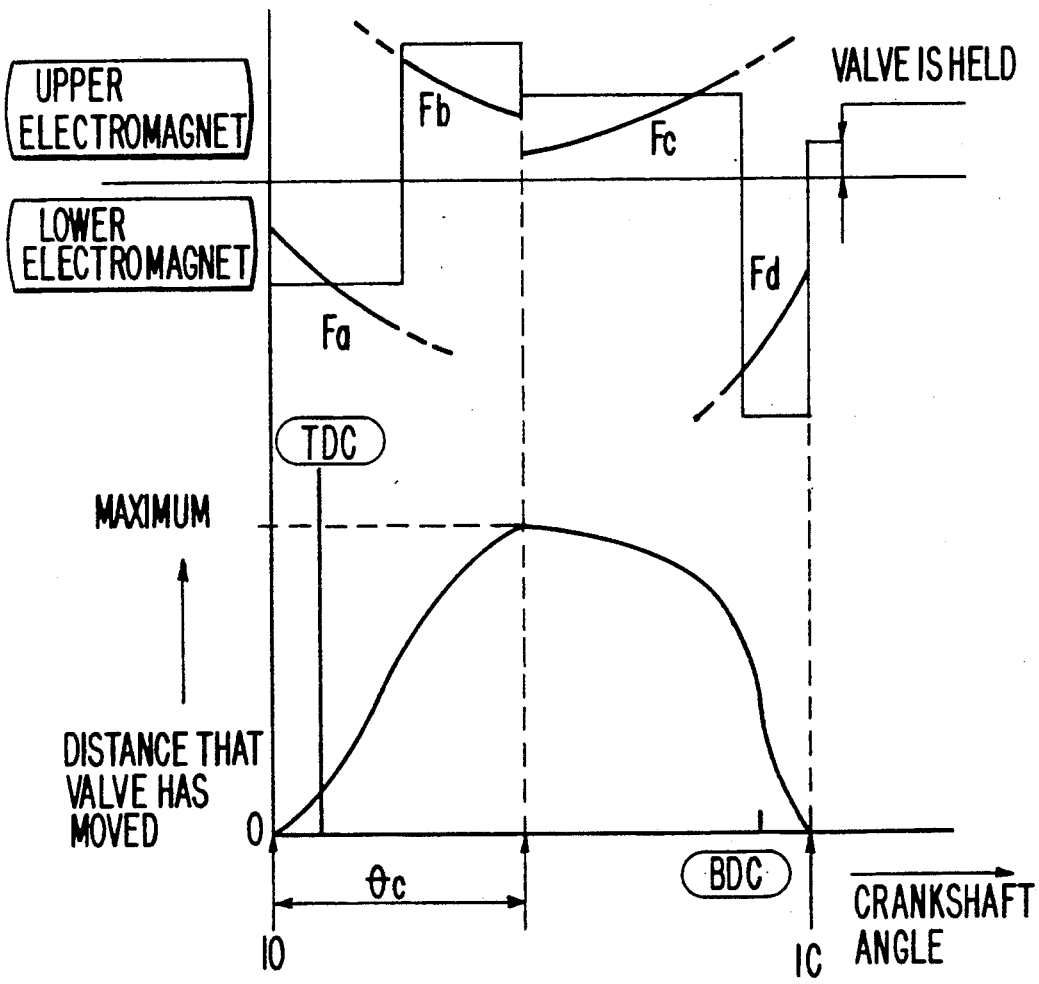
FIG. 4 is a graph showing the manner in which the supply of electric power to electromagnets is controlled for valve control.

FIG. 4 shows on its lower side a curve corresponding to the cam profile of the camshaft. The vertical axis of FIG. 4 represents the valve opening (the distance which the valve has moved) corresponding to the lift of the cam profile, and the horizontal axis represents the crankshaft angle which is indicated from an angle IO where the intake valve starts to be opened to an angle IC where the intake valve is fully closed. FIG. 4 shows on its upper side how the upper and lower electromagnets 52, 53 are energized, and also attractive forces produced by these electromagnets. The attractive forces produced by the electromagnets are inversely proportional to the square of the distance up to the magnetic movable member 57, and are indicated by quadratic curves Fa, Fb, Fc, Fd. When the intake valve 8 is closed, the coil of the upper electromagnet 52 is continuously energized to keep the intake valve 8 closed, and the intake valve is attracted upwardly through the movable member 57. At the timing of IO, the upper electromagnet 52 is de-energized to remove the upward attractive force, and the lower electromagnet 53 is energized to generate a downward attractive force Fa. The intake valve 8 is now moved downwardly to open the intake port. When the crankshaft angle reaches a first predetermined angle, the lower electromagnet 53 is de-energized and the upper electromagnet 52 is energized to produce an upward attractive force Fb, thereby reducing the speed of downward movement of the intake valve 8. When an angle $\theta c$ is reached from IO, the valve opening (the distance which the valve has moved) is maximized. When the angle $\theta c$ is reached, the voltage at which the upper electromagnet 52 is energized is varied to change the upward attractive force from Fb to Fc. Then, when the crankshaft angle reaches a second predetermined angle, the upper electromagnet 52 is de-energized and the lower electromagnet 53 is energized to produce a downward attractive force Fd which reduces the speed of downward movement of the intake valve 8. The shock which is caused when the intake valve 8 is seated can therefore be lessened. When the valve control system is inactivated, as when the motor vehicle is stopped, the intake valve 8 is prevented from moving downwardly by the coil spring 58 which normally urges the intake valve 8 upwardly. The spring force of the coil spring 58 is selected not to affect the attractive forces Fa, Fd produced by the lower electromagnet 53.

While the control of operation of the intake valve 8 has been described above, the exhaust valve can similarly be controlled in its operation except that the timing to open and close the exhaust valve is different.

With the valve control system of the present invention, as described above, the intake and exhaust valves of the internal combustion engine are operated under electromagnetic forces by the electromagnetic actuator means, and the electromagnetic actuator means is controlled depending on the engine rotational speed such that the angle in which the intake and exhaust valves are open with respect to the crankshaft angle will be smaller when the engine rotational speed is lower and larger when the engine rotational speed is higher. Therefore, the intake and exhaust efficiency can be increased in the full range of engine rotational speeds. Since the intake and exhaust valves are made of a ceramic material, they are lighter than metal valves, and can operate smoothly as inertial forces applied thereto are small. In addition, the intake and exhaust valves may be driven by smaller drive forces generated by the electromagnetic actuator means.

Although a certain preferred embodiment has been shown and described, it should be understood that many changes and modifications may be made therein without departing from the scope of the appended claims.

What is claimed is:

1. A control system for controlling intake and exhaust valves of an internal combustion engine, said valves each being constructed of a ceramic material and each having a valve body and an elongated valve stem, said stem having one end attached to said body and a distal end spaced from said body, said system comprising:

electromagnetic actuator means for opening and closing the intake and exhaust valves, said actuator means comprising an actuator for each valve, each actuator comprising a magnetic member mounted on the corresponding valve stem and first and second electromagnets, said electromagnets being spaced apart longitudinally of said stem and disposed on respective opposite sides of the magnetic member;

an engine speed sensor for detecting the rotational speed of the internal combustion engine;

a crankshaft angle sensor for detecting the angular position of the crankshaft of the internal combustion engine;

timing calculating means for calculating the timing at which the intake and exhaust valves are to be opened and closed, based on a detected signal from said crankshaft angle sensor;

calculating means for calculating the angular positions at which the intake and exhaust valves are to be opened and closed with respect to the crankshaft angle, based on detected signals from said engine speed sensor and said crankshaft angle sensor, said calculating means including means for reducing the duration of the period during which the intake and exhaust valves are open when the rotational speed of the internal combustion engine is lower and for increasing the duration of the period during which the intake and exhaust valves are open when the rotational speed of the internal combustion engine is higher; and control means for applying drive signals to said electromagnetic actuator means in response to the calculated angular position, said control means comprising operating means for each valve for selectively energizing one of the electromagnets to open the corresponding valve, deenergizing said one electromagnet and energizing the other electromagnet to close said corresponding valve when the crank shaft reaches a first predetermined angular position, and deenergizing said other electromagnet and energizing said one electromagnet to open said corresponding valve when the crank shaft reaches a second predetermined angular position.

* * * * *

UNITED STATES PATENT AND TRADEMARK OFFICE

CERTIFICATE OF CORRECTION

PATENT NO. : 5,050,543

DATED : September 24, 1991

INVENTOR(S) : Hideo Kawamura

It is certified that error appears in the above-identified patent and that said Letters Patent is hereby corrected as shown below:

On the title page: [56] References Cited - U.S. Patent Documents

"4,258,672 3/1981 Hietikko" should be --4,258,672 "Hietikko" --.

"4,544,986 7/1986 Long" should be --4,544,986 "Long".

delete "4,598,675 10/1985 Buchl":

"4,700,684 10/1987 Pishinger et al." should be --"4,700,684 10/1987 Pischinger et al.--;

Column 3, line 68, "ar" should be --are--.

Signed and Sealed this

Eleventh Day of May, 1993

*Attest:*

Michael K. Kirk

MICHAEL K. KIRK

*Attesting Officer*

*Acting Commissioner of Patents and Trademarks*